US010036600B2

(12) United States Patent
Maranli

(10) Patent No.: US 10,036,600 B2
(45) Date of Patent: Jul. 31, 2018

(54) BOLT FOR FIREARMS AND CAM PIN THEREFOR

(71) Applicant: Maranli Automation, Inc., Mt. Orab, OH (US)

(72) Inventor: Hasan Maranli, Sardinia, OH (US)

(73) Assignee: Maranli Automation, Inc., Mt. Orab, OH (US)

( * ) Notice: Subject to any disclaimer, the term of this patent is extended or adjusted under 35 U.S.C. 154(b) by 0 days.

(21) Appl. No.: 15/384,724

(22) Filed: Dec. 20, 2016

(65) Prior Publication Data

US 2018/0172373 A1 Jun. 21, 2018

(51) Int. Cl.
*F41A 3/26* (2006.01)

(52) U.S. Cl.
CPC ..... *F41A 3/26* (2013.01)

(58) Field of Classification Search
CPC ..... F41A 3/14; F41A 3/16; F41A 3/26; F41A 3/28; F41A 3/68
See application file for complete search history.

(56) References Cited

U.S. PATENT DOCUMENTS 2,424,264 A * 7/1947 Yorks ..... F41A 3/26 42/16
2,425,434 A * 8/1947 Loomis ..... F41A 19/13 89/132
2,685,754 A * 8/1954 Crittendon ..... F41A 3/26 42/16
2,951,424 A 9/1960 Stoner
3,377,730 A * 4/1968 Lewis ..... F41A 3/18 42/16
3,648,562 A * 3/1972 Loeble ..... F41A 19/13 89/148
3,738,043 A * 6/1973 Green ..... F41A 19/58 42/69.02
3,969,983 A * 7/1976 Zellweger ..... F41A 3/26 89/185
4,095,507 A * 6/1978 Close ..... F41A 5/20 89/129.02
6,484,430 B1 * 11/2002 Robinson ..... F41A 3/26 42/25
6,971,202 B2 * 12/2005 Bender ..... F41A 3/36 42/16
7,886,470 B1 * 2/2011 Doiron ..... F41A 3/46 42/16
8,991,295 B2 3/2015 Larue
2002/0073592 A1 * 6/2002 Murello ..... F41A 3/26 42/25
2005/0066564 A1 * 3/2005 Keeney ..... F41A 3/26 42/16
2005/0223613 A1 * 10/2005 Bender ..... F41A 3/36 42/16
2010/0319527 A1 * 12/2010 Giefing ..... F41A 3/26 89/185
2014/0251118 A1 * 9/2014 Moretti ..... F41A 3/20 89/23
2017/0074607 A1 * 3/2017 Lewis ..... F41A 3/26
2017/0074609 A1 * 3/2017 Michlin ..... F41A 3/46

* cited by examiner

*Primary Examiner* — Derrick R Morgan
(74) *Attorney, Agent, or Firm* — Wood Herron & Evans LLP

(57) ABSTRACT

An improved firearm bolt comprising a blind end cam pin bore therein, with closed end within the bolt. Blind bore end and distal cam pin end are in complementary configurations. Alternatives are discussed.

6 Claims, 8 Drawing Sheets

BOLT FOR FIREARMS AND CAM PIN THEREFOR

FIELD OF THE INVENTION

This invention relates to firearms and more particularly to firearms having breech bolts such as firearms of the AR-15, AR-10, M-16 and variants thereof.

BACKGROUND OF THE INVENTION

In firearms of these types, breech bolts function to strip a live cartridge from a magazine at the firearm receiver, drive the stripped cartridge into the breech end of a firearm barrel, lock to the barrel breech, support the cartridge head during firing, and extract the spent brass of the cartridge from the breech end of the barrel after firing for ejection. Generally such bolts find application in both semi-automatic and fully automatic operations of these firearms.

In firearms such as the AR-15, AR-10, M-16 and variant platforms, such bolts are carried, for example, by a bolt carrier. The bolts are operationally connected to the carriers via a bolt cam pin extending through a cam slot in the carrier and into a transverse cam pin through-bore in the bolt. The lower end of the transverse open bore may have small staked projections limiting further passage of the cam pin, but the transverse bore extends through the bolt. Forces acting on the carrier serve to rotate the bolt, through the action of the cam pin in the cam slot, in one direction for loading and locking and in an opposite direction for unloading or extraction and consequent brass ejections. Such structure and operation is detailed in Stoner U.S. Pat. No. 2,951,424 and Larue U.S. Pat. No. 8,991,295, both of which are expressly incorporated herein as background by this express reference as if fully expressed in writing herein.

In some instances such as in high use, i.e. high round count, firearms, in firearms shooting heavy loads, in firearms where bolt materials are insufficiently strong, or are defective, in firearms where manufacturing tolerances are of wider range than desired, or in firearms exhibiting other aberrations, such prior bolts are attended by structural weaknesses, particularly in the bolt walls extending beside and around the open-ended cam pin bore through the bolt. The weaker bolt walls around the cam pin bore and between the bore openings thus constitute a weaker area in the bolt where the bolt may split, crack or disintegrate adversely affecting further action of the firearm. Failure of the firearm can be catastrophic to the user particularly when in an engagement in a military, law enforcement or defensive circumstance. While various manufacturing processes have been used to treat (peening) or to inspect (magnetic flux or particle processes) prior bolts, such prior bolts are still subject to failure proximate the open cam pin bore.

It has thus been one objective of this invention to provide an improved bolt structure for a firearm.

Another objective of the invention has been to provide a firearm bolt for AR-15, AR-10, M-16 and variant firearms with less propensity for breakage than that of prior bolts.

A yet further objective of the invention has been to provide an improved bolt having a cam pin bore therein, but without being subject to functional bolt weakness at the bore.

A still further objective of the invention has been to provide an improved bolt and cam pin combination.

SUMMARY OF THE INVENTION

To these ends, a preferred embodiment of the invention contemplates a firearm bolt having a cam pin bore therein but with enhanced structural integrity in the bolt surrounding the cam pin bore. With more particularity, an improved bolt according to one embodiment of the invention has a blind cam pin bore in the bolt, but the bore does not extend through the bolt.

In a yet further detail of a preferred embodiment of the invention a bolt has a blind cam pin bore which does not extend wholly through the bolt, and where the blind end is structurally compatible with a non-linear cam pin end.

A further aspect of the invention contemplates a blind cam pin bore terminating in one of a flat, radiused or chamfered blind end in combination with a cam pin having an end corresponding respectively with a respective blind cam pin bore end.

In a further aspect of the invention, the blind cam pin bore terminates in one of a flat, radiused or chamfered blind end within the bolt.

In a further embodiment of the invention a bolt has a cam pin bore therein having a first major bore diameter for the cam pin and a yet second smaller diameter through hole extending through the bolt wall from a distal end of the blind cam pin bore.

As such, the invention provides a strong, reliable bolt for a firearm having a cam pin bore wherein the bolt has a stronger wall structure around the bore than in prior bolts.

These and other advantages and embodiments will be readily apparent from the following written detailed description of the invention and from the drawings in which:

DETAILED DESCRIPTION OF THE INVENTION

With respect to the foregoing, the basic structure and function, since somewhat modified, of the AR-15, AR-10, M-16 of variant firearm platforms are disclosed in Stoner U.S. Pat. No. 2,951,424 expressly incorporated herein by reference. Further details of such current platform firearms are fully disclosed and illustrated in LaRue U.S. Pat. No. 8,991,295 also expressly incorporated herein by reference.

Figure 1:
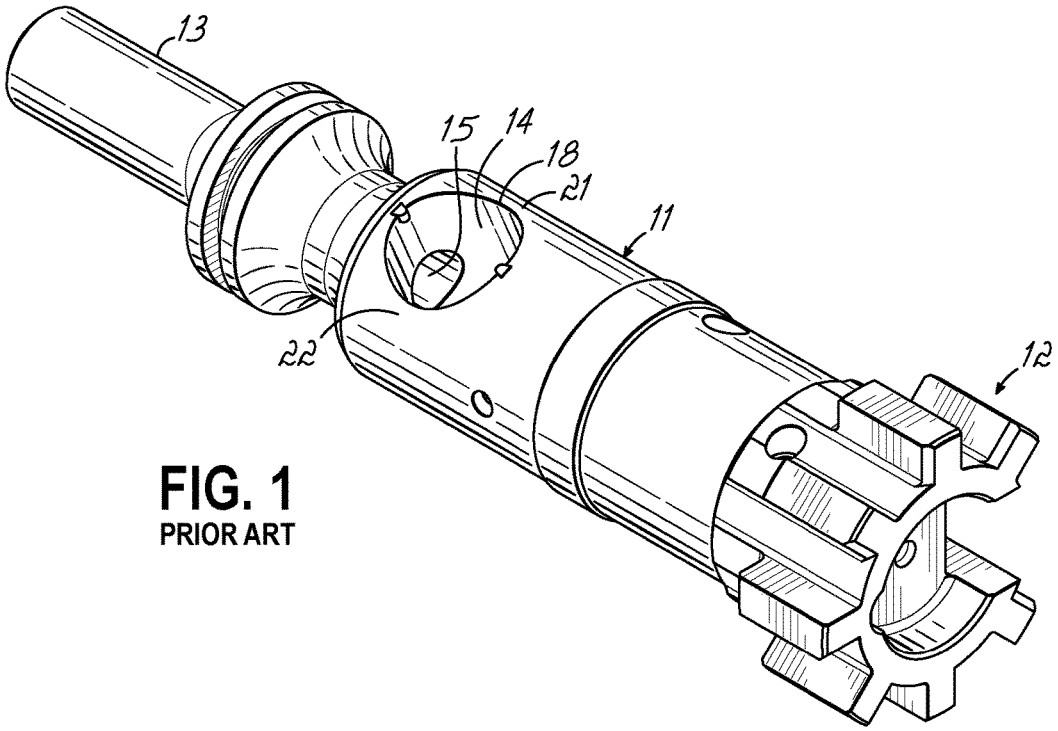
FIG. 1 PRIOR ART
FIG. 1 is an isometric view of a prior art bolt typical of an AR-15, AR-10 M-16, or variant thereof rifle platform.
Figure 2:
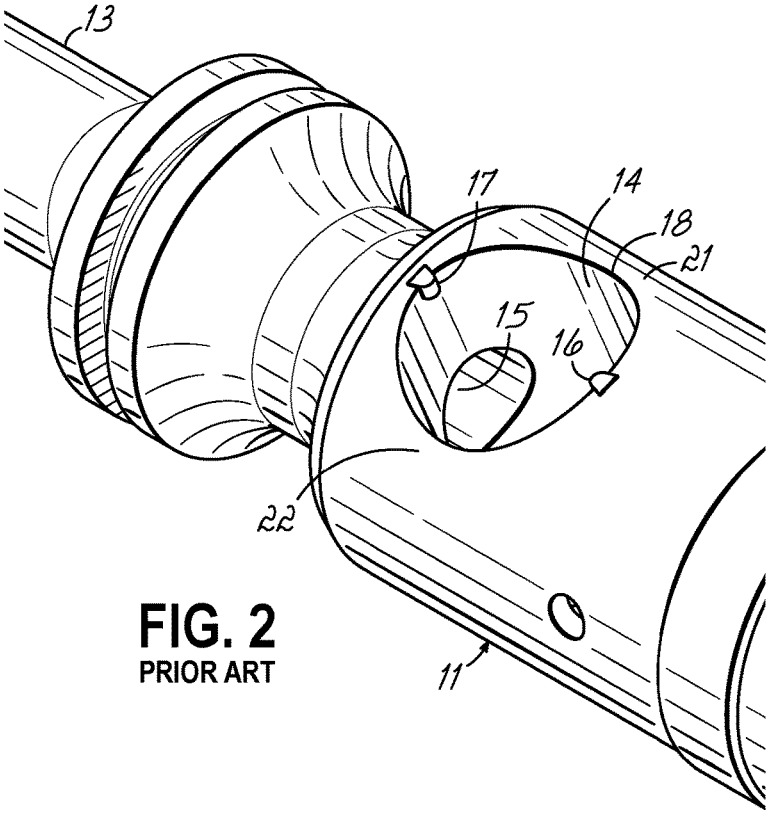
FIG. 2 PRIOR ART
FIG. 2 is a view of the prior art bolt of FIG. 1, showing the staking at the bottom end of the cam pin bore.

Turning now to the drawings, FIGS. 1-4 illustrate prior art bolts now typically in use in AR-15, AR-10, M-16 firearms and firearm variants thereof. As noted in FIG. 1, such prior art bolts include a bolt body 11, forward breach locking lugs 12, a rear tail bolt 13, cam pin through bore 14 extending all the way through body 11, and a firing pin through bore 15. FIG. 2 is an enlarged view of a bolt portion of FIG. 1, illustrating discrete bolt body stakes 16, 17, detented into the aperture 18 formed by the bore 14 in the outer surface of bolt body 11 at one lower open end of cam pin through bore 14.

Figure 3:
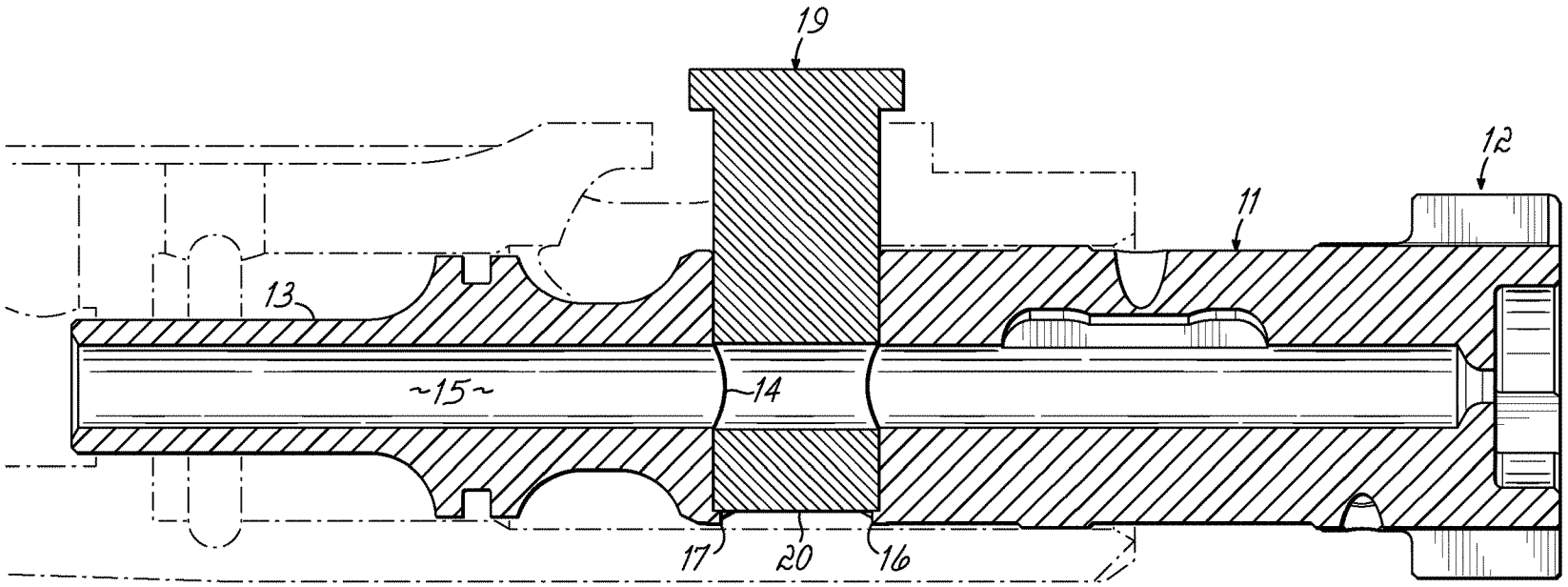
FIG. 3 PRIOR ART
FIG. 3 is a sectional view of the prior art bolt of FIGS. 1 and 2 illustrating seating of the cam pin in the prior art bolt and orientation thereof in a bolt carrier, as well as a portion of a cam pin slot in the carrier.
Figure 4:
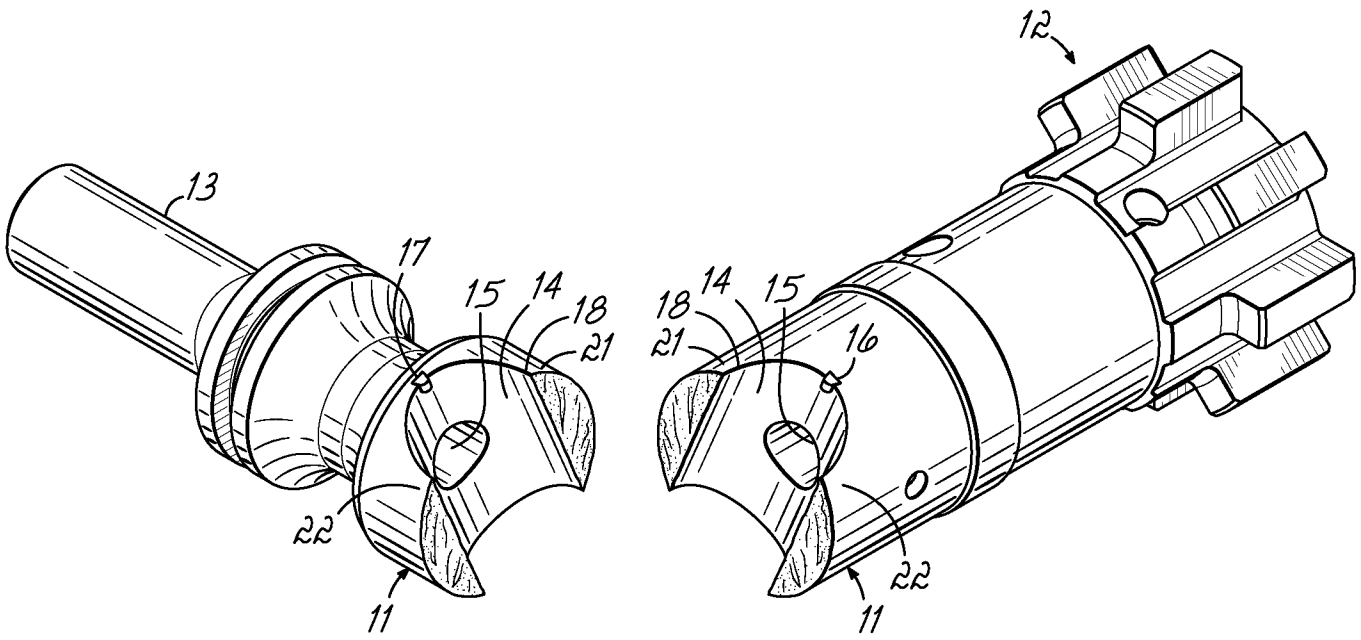
FIG. 4 PRIOR ART
FIG. 4 is an isometric view of the prior art bolt illustrating the bolt in broken form about the prior cam pin bore.

As illustrated in FIG. 3, a cam pin 19 resides in cam pin bore 14, but has a lower end 20, the periphery of which is engaged by discrete body stakes 16, 17 to prevent further passage of pin 19 through bore 14.

Bolt body 11, as shown in FIGS. 1 and 2 surrounds through bore 14. In other words, when through bore 14 is formed, bolt body wall portions 21, 22 remain in body 14, extending around sides of through bore 14.

Thus in the prior art bolts of FIGS. 1-4, the bolt body is structurally the weakest at wall portions 21,22 at the area about bore 14.

It is at the through bore 14 where bolt body wall portions tend to break, crack or separate for an of a variety of reasons as noted above and is pictorially illustrated in FIG. 4. This can result in catastrophic failure of the firearm.

Turning now to FIGS. 5-10B, the invention and exemplary embodiments thereof are clearly illustrated.

Figure 5:
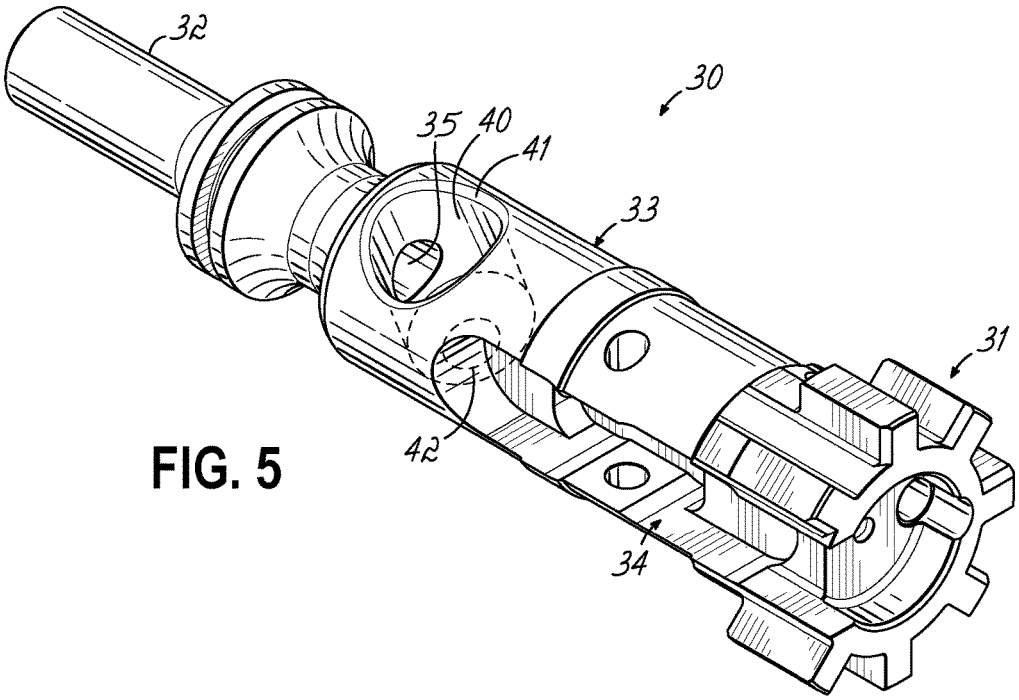
FIG. 5 is an isometric view of one embodiment of a bolt according to the invention, illustrating a blind end cam pin bore and a typical extractor relief in such bolt.

In FIG. 5 a bolt 30 has forward locking lugs 31 and a tail end 32 as typical. Bolt 30 is further defined by bolt body 33 having a relief 34 for a typical extractor (not shown). Bolt 30 also has a firing pin bore 35 as is typical. It will be appreciated bolt body 33 has a preferably cylindrical outer surface.

According to the invention, bolt 30 further includes a blind cam pin bore 40 having an upper end 41 opening in the body 33 at a body surface, and a lower or distal, preferably blind, closed end 42. The only opening of bore 40 is at one position only on the bolt surface.

Figure 6A:
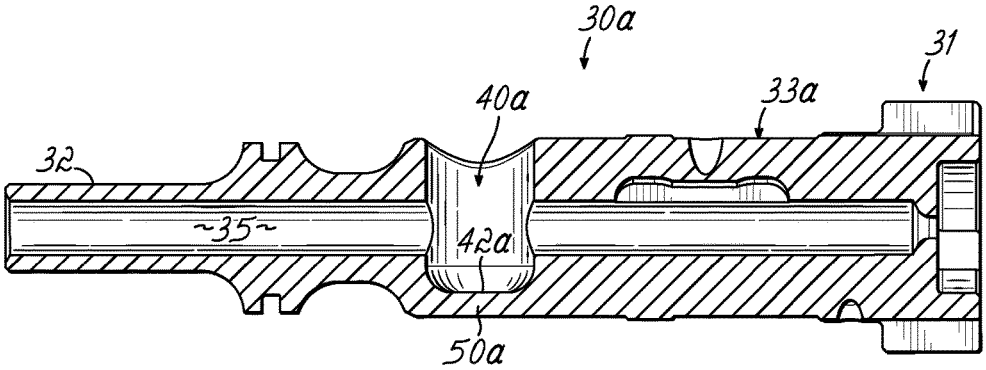
FIG. 6A is a sectional view of one embodiment of a bolt as in FIG. 5 illustrating a blind cam pin bore having a radiused bottom, closed end.

Details of the bore 40 and its blind end are clearly shown in FIGS. 6A though 8B.

Figure 6B:
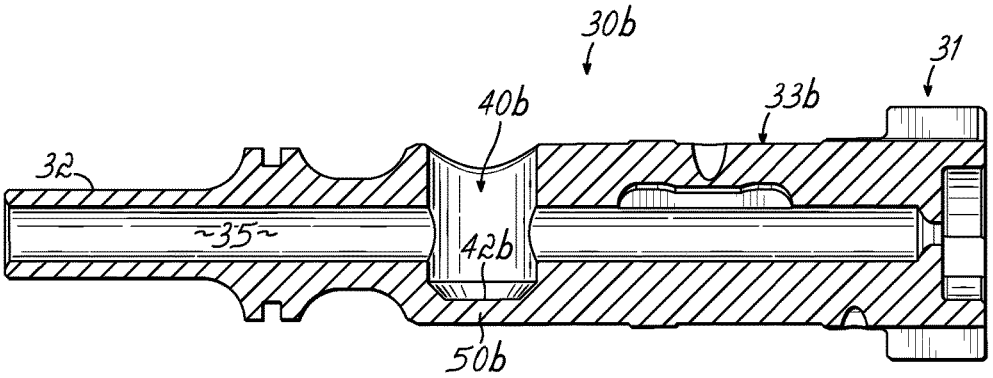
FIG. 6B is a sectional view of one embodiment of a bolt as in FIG. 5 illustrating a blind cam pin bore having a chamfered bottom closed end.
Figure 6C:
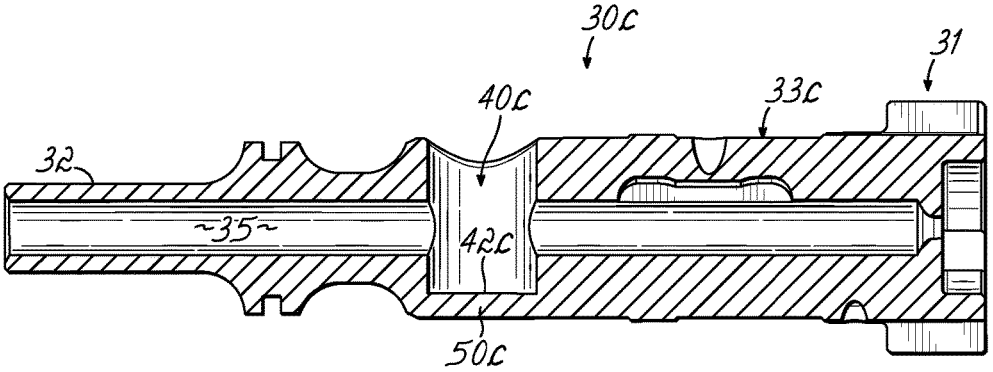
FIG. 6C is a sectional view of one embodiment of a bolt as in FIG. 5 illustrating a blind cam pin bore having a flat bottom closed end.

FIGS. 6A through 6C illustrate alternative bolt embodiments 30*a*-30*c*, each having a blind end through bore, 40*a*, 40*b*, 40*c*, but of different blind end construction. In the Figs., similar numbers are provided with letter suffixes to related structures in the alternative embodiments.

Bolt 30*a* has blind end bore 40*a* terminating in a radiused blind end 42*a* best seen in FIGS. 6A, 7A, 7B, 8A and 8B. Blind end 42*a* is radiused as in these Figs. in its lower portion as shown within bore 40*a* but bore 40*a* does not extend through body 33*a* of bolt 30*a*.

Walls 48*a* and 49*a* of body 33*a* continue around bore 40*a*. Also, and significantly in accord with the invention, wall 50*a* of body 33*a* continues under the blind end of bore 40*a* and through the body 33*a*. Thus the bolt body 33*a* extends both around and under bore 41*a* as clearly shown in FIGS. 6A-6C (all embodiments) and FIGS. 7A, 7B, 8A and 8B.

Accordingly, bolt body 33*a* is structurally enhanced not only by walls 48*a*, 49*a* around bore 41*a*, but wall 50*a* extending under blind bore 41*a*. Provision of blind bore 41*a* substantially enhances the structural integrity of bolt 30*a*, adding a structural integrity to the bolt 30*a* in the areas proximate bore 41*a*.

Body 33*a* of bolt 30*a* is thus not weakened by any provision open through bore, substantially open at both its ends to the outer surface of the bolt 30*a* at opposite ends of the bore as in the prior bolts.

Similar structure of the bolt and its functionality is also present in the embodiments of FIGS. 6B and 6C which differ from that embodiment of FIG. 6A in that the configurations of the lower end portions of their cam pin bores 40*b*, 40*c*, respectively, vary.

For example, in the embodiment of FIG. 6B, lower blind end 42*b* of bore 40*b* is not radiused as in FIG. 6A (bolt 30*a*), but rather terminates in a chamfered configuration at blind end 42*b*. Bore 40*b* does not extend through body 33*b* of bolt 30*b* but leaves a bolt wall 50*b* like wall 50*a* in bolt 30*a*, with structural enhancement as in bolt 30*a*.

In the embodiment of FIG. 6C, blind bore 41*c* terminates in a flat closed end 42*c*, without extending through bolt body 33*c* of 30*c* and thus providing structural enhancement as in bolt 30*a*. Blind end bore 40*c* thus leaves wall 50*c* in bolt 30*c*, strengthening the bolt body around bore 40*c*.

Figure 8A:
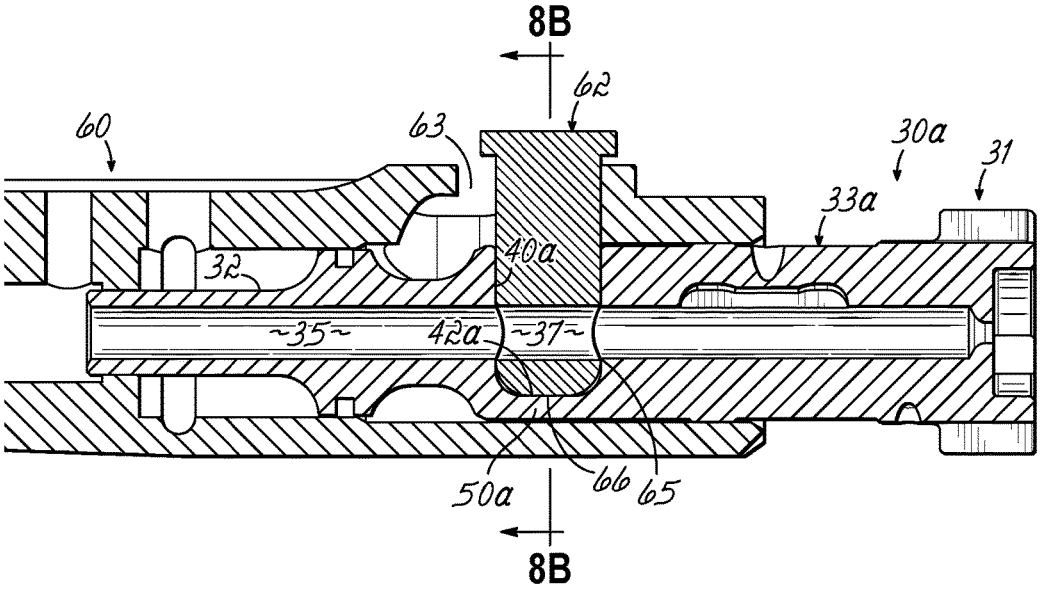
FIG. 8A is an isometric sectional view of a bolt of FIGS. 5, 6A, 7A and 7B illustrating the assembly of that bolt, cam pin and a bolt carrier.
Figure 8B:
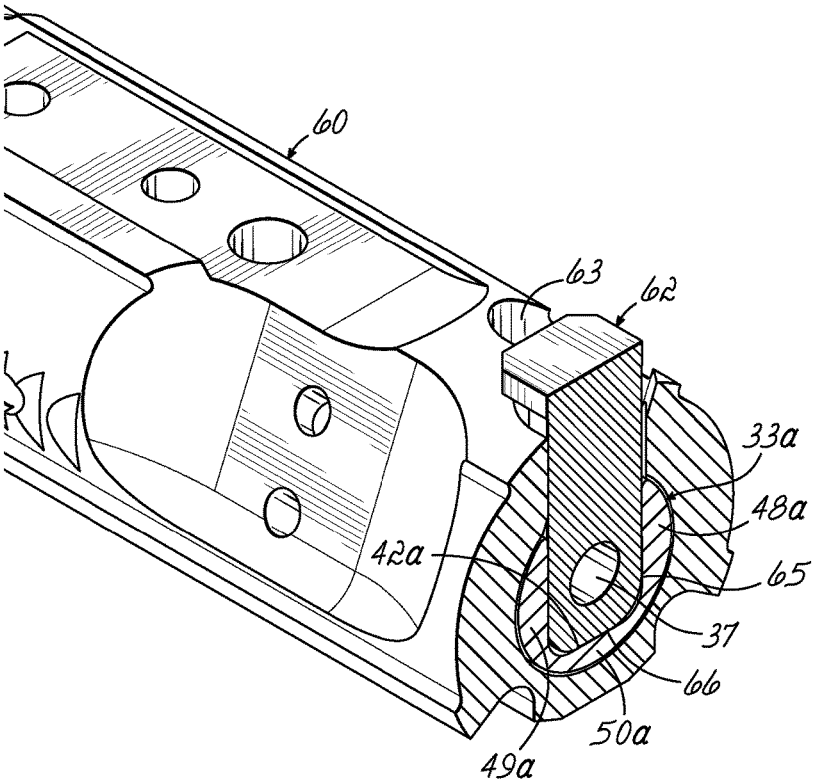
FIG. 8B is an isometric cross-sectional view taken along lines 8B-8B of FIG. 8A, further also illustrating the clearance between the radiused cam pin as in FIGS. 8A and 8B.

With further reference to FIGS. 8A and 8B, there is shown a bolt such as bolt 30*a* assembled to a bolt carrier 60, and with a cam pin 62 extending into bolt 30*a* and thorough a cam slot 63 in carrier 60. Bolt 30*a* is driven, and limited in motion, by cam pin 62 and slot 63 as the carrier itself is reciprocated in the firearm (not shown). It is the pressure, impact and stress, exhibited at bolt 30*a*, pin 62 and slot 63 particularly at the bolt around blind bore 40*a*, ameliorated in the embodiments of the invention herein.

Figure 9:
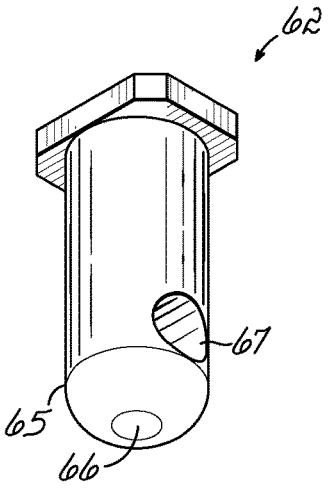
FIG. 9 is an isometric view of cam pin bolt useful for example in the bolt of FIGS. 6A, 6D, 7A-8B for example.
Figure 10A:
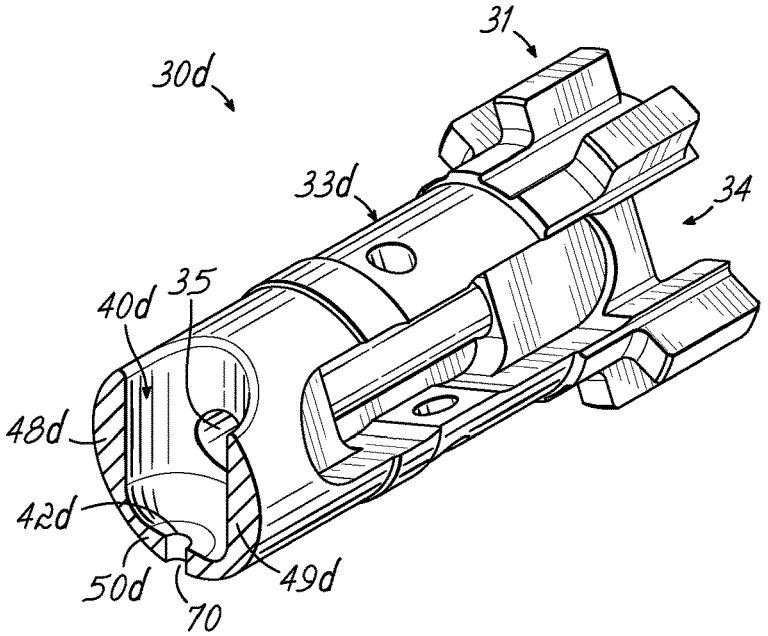
FIG. 10A is an isometric view of an a forward portion of an alternative embodiment of a bolt according to the invention as in FIG. 6D and having a small through hole in the bottom end of the radiused end of the cam pin bore.
Figure 10B:
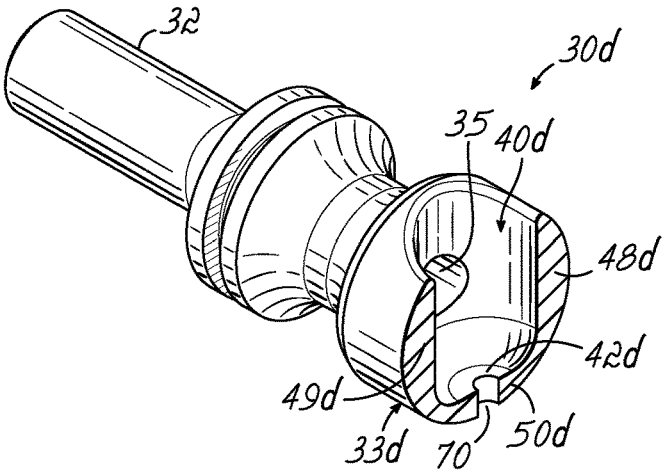
FIG. 10B is an sectional view of a rear end portion of an alternative embodiment of FIG. 10A.

In FIG. 9, there is shown a cam pin 62, having a lower end 65 terminating at end 66, which lower end is radiused and configured like lower end 42*a* of bore 40*a* (FIGS. 8A, 8B). Cam pin 62 has a transverse thorough hole 37 for passage of a typical firing pin (not shown).

From FIGS. 8A, 8B, it will be appreciated that there is a slight clearance between complimentary cam pin end 65 and radiused end 42*a* of bore 40*a*. In this regard, note pin 62 bottoms out (FIGS. 8A, 8B) at its end 66 (FIG. 9), and not at the complementary respective radiused surfaces.

It will be further understood that a cam pin preferably useful with the bolt embodiment 30*b*, as in FIG. 6B will have a distal chamfered lower end complementary to the configuration of blind bore 40*b* therein, and terminating at a flat end against bottom 42*b* of bore 40*b*, with a slight clearance at the respectively chamfered surfaces.

Figure 6D:
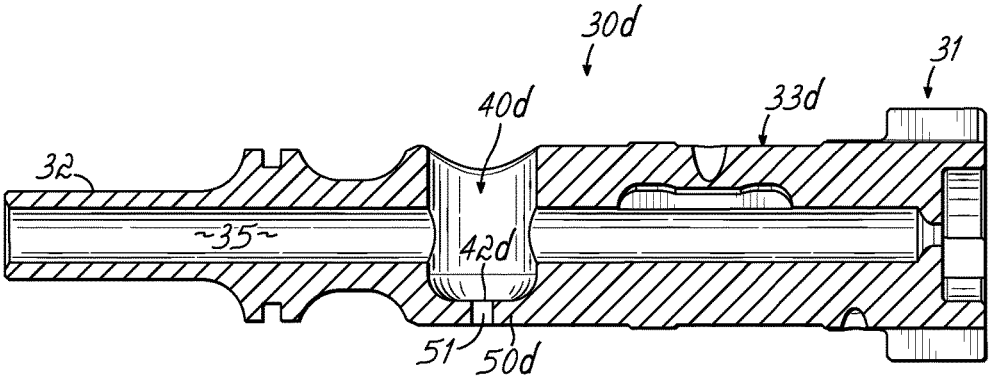
FIG. 6D is a sectional view similar to FIG. 6A but showing a small through hole from the major cam pin blind bore.
Figure 7A:
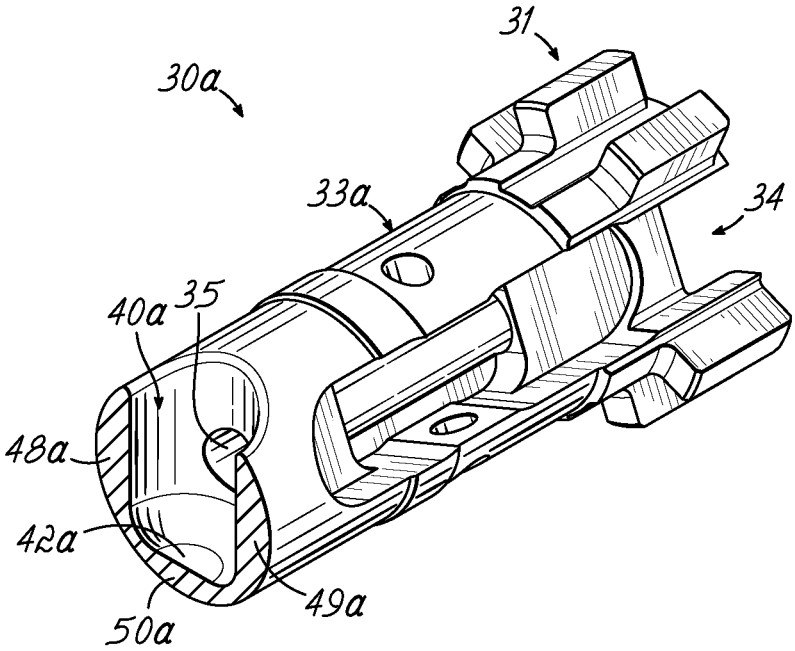
FIG. 7A is an isometric view of a forward portion of one embodiment of a bolt as in FIGS. 5 and 6A, illustrating the bolt wall section about the forward side of the blind end cam pin bore.
Figure 7B:
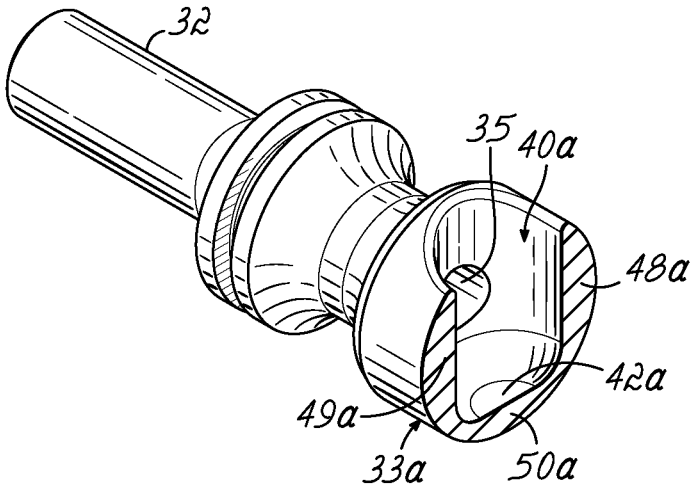
FIG. 7B is an isometric view of a rear end portion of a bolt as in FIGS. 5, 6A and 7A, illustrating the bolt wall section about the rearward side of the blind cam pin bore.

While these foregoing embodiments as described have a fully blind end bore 40 (40*a*, 40*b*, 40*c*), the invention also contemplates an alternative embodiment (FIGS. 10A, 10B and 6D) where there is a very small through hole 70 at the bottom 42*d* of an essentially blind bore 40*d*, in the body 33*d* of alternate bolt 30*d*. The through hole from blind bore end to the bolt surface is substantially smaller then the blind bore diameter and cross section. (See also FIG. 6D illustrating a small through hole 51 extending through bolt 30*d* from essentially blind bore 40*d*.

The lower end of bore 40*d* can be radiused, chamfered or flat, as in the foregoing embodiments, however the provision of through hole 70 (on 51, FIG. 6D), having a small diameter or cross-section as compared to bore 40*d*, provides further functionality for lubrication, low frictional, cleaning and other functions. All this without foregoing the additional structural integrity of the essentially solid wall 50*d* and adjoining bolt body walls 48*d*, 49*d* about bore 40*d*. Apart from hole 70, the remainder of the bottom of blind bore 40*d* remains closed, thus bore 40*d* is essentially blind-ended.

It will be further appreciated that this invention and its various embodiments are universally retro-fittable to current bolt carriers for AR-15, AR-10, M-16 firearms and variants thereof. Only the bolts and associated cam pins are exchanged.

It will also be appreciated that the blind cam pin bores herein may or may not have a small though hole extending from the blind end to the bolt surface where the through hole is described. Where not described as an option, the cam pin bore is closed off entirely within the bolt body.

There are preferably no external dimension changes to the bolts, which are compatible with current bolt carriers. Bolts and associated cam pins can thus be supplied for new firearms as well as retro-fitted with existing firearms and their bolt carriers, all while providing the enhanced reliability, structural and functional capabilities and advantages discussed above.

What is claimed is:

1. A bolt for a firearm of the type having a reciprocal bolt carrier said bolt comprising:

a bolt body;

a first firing pin bore extending in said bolt body;

a cylindrical cam pin bore extending transversely into said bolt body from one side thereof and said cam pin bore having side bore was and a bottom bore wall defining a dosed cam pin bore end within said bolt body;

a cam pin operably disposed in said cam pin bore;

said cam pin having a first end in engagement with said bottom bore wall of said cam pin bore and a second firing pin bore extending transversely through said cam pin for receiving a firing pin;

said cam pin at a second end having a flanged end spaced from said bolt when said cam pin is operably disposed in said cylindrical cam pin bore;

said bolt body having walls extending around said bore on two opposite side walls thereof and adjacent said bottom wall of said bore;

wherein said transverse firing pin bored in said cam pin is aligned with the said firing pin bore in said bold body when said cam in first end operably engages said bottom wall of said cam pin bore.

2. A bolt as in claim 1 wherein said bottom wall of said cam pin bore in said bolt body comprises a flat bottom wall.

3. A bolt as in claim 1 wherein said bottom wall of said cam pin bore in said bolt body comprises an inwardly curved radiused configuration.

4. A bolt as in claim 1 wherein said bottom wall of said cam pin bore in said bolt body comprises an inwardly tapered chamfered configuration.

5. A bolt as in claim 1 wherein said flanged end of said cam pin is spaced from said bolt by the engagement of said cam pin first end with said bottom wall of said cam pin bore.

6. A bolt as in claim 1 in combination with said reciprocal bolt carrier, wherein said flanged end is spaced from said bolt carrier by the engagement of said cam pin first end with said bottom wall of said cam pin bore.

* * * * *